US007832561B2

(12) United States Patent
Polk, III

(10) Patent No.: US 7,832,561 B2
(45) Date of Patent: Nov. 16, 2010

(54) PACKAGING APPARATUS AND METHODS FOR DEMONSTRATING OBJECT MOTION

(76) Inventor: Louis F. Polk, III, 4740 Lodge La., Excelsior, MN (US) 55331

( * ) Notice: Subject to any disclaimer, the term of this patent is extended or adjusted under 35 U.S.C. 154(b) by 441 days.

(21) Appl. No.: 11/656,870

(22) Filed: Jan. 22, 2007

(65) Prior Publication Data

US 2008/0308085 A1 Dec. 18, 2008

(51) Int. Cl.
*B65D 77/02* (2006.01)

(52) U.S. Cl. ..... 206/471; 206/315.1; 206/579

(58) Field of Classification Search ..... 206/315.1, 206/579, 471, 779; 124/1, 6
See application file for complete search history.

(56) References Cited

U.S. PATENT DOCUMENTS

| | | | | |
|---|---|---|---|---|
| 2,636,738 | A * | 4/1953 | Abagoff | 124/16 |
| 3,570,467 | A * | 3/1971 | Belokin, Jr. | 446/38 |
| 4,145,050 | A | 3/1979 | Sullivan et al. | |
| 4,277,068 | A * | 7/1981 | Sasaki | 124/10 |
| 5,289,916 | A | 3/1994 | Mickelberg | |
| 5,292,134 | A | 3/1994 | Schlundt et al. | |
| 5,435,447 | A * | 7/1995 | Weatherford et al. | 206/349 |
| 5,494,252 | A | 2/1996 | Amit et al. | |
| 5,595,295 | A * | 1/1997 | Lin | 206/349 |
| 5,622,258 | A | 4/1997 | Baublitz et al. | |
| 5,718,335 | A | 2/1998 | Boudreaux | |
| 6,030,274 | A | 2/2000 | Kaplan | |
| 6,126,008 | A | 10/2000 | Cox | |
| 6,311,839 | B1 | 11/2001 | Lo | |
| 6,401,932 | B1 | 6/2002 | Weinstein et al. | |
| D462,903 | S | 9/2002 | Yuen | |
| 6,467,617 | B1 | 10/2002 | Chen | |
| D481,941 | S | 11/2003 | Kyne et al. | |
| 6,899,222 | B2 | 5/2005 | Jones et al. | |
| 7,044,305 | B2 | 5/2006 | Girondi et al. | |
| 7,568,578 | B2 * | 8/2009 | Berman | 206/335 |
| 2002/0162771 | A1 | 11/2002 | Van Wagenen et al. | |

FOREIGN PATENT DOCUMENTS

| | | | |
|---|---|---|---|
| WO | WO 2006049649 A1 * | 5/2006 | |

* cited by examiner

*Primary Examiner*—J. Gregory Pickett
(74) *Attorney, Agent, or Firm*—Clise, Billion & Cyr, P.A.; Tim Clise

(57) ABSTRACT

Packaging apparatus for retaining a projectile launched from a launcher are disclosed. The packaging defining a chamber to receive the projectile and permit the visualization of the flight of the projectile after it is launched from the launcher. The launcher configured to impart a motive force to the projectile and to launch the projectile from the launcher. The launcher includes an actuator to permit a user to launch the projectile from the launcher and into the chamber while at least a portion of the launcher is secured within the packaging.

15 Claims, 8 Drawing Sheets

PACKAGING APPARATUS AND METHODS FOR DEMONSTRATING OBJECT MOTION

BACKGROUND OF THE INVENTION

1. Field of the Invention

The present inventions relate to retail packaging and, more particularly, to retail packaging for demonstrating the motion of a packaged object.

2. Description of the Related Art

Packaging of products frequently plays an important role in the marketing of products in the retail environment. For certain classes of products, the packaging and presentation of the product and its operation can substantially affect the sales volume of that product.

A wide range of products are sold in retail outlets which are designed to launch projectiles. These products range from tools to sporting goods and toys. Prior packaging systems for products have permitted the demonstration of products while in the packaging. These packaging systems have typically allowed potential purchasers to visualize lights and motion, feel vibrations, and/or hear the sounds produced by the packaged product. These types of packaging systems have seen substantial commercial success.

Prior systems have however typically required that the components of the product remain secured or connected to one another by or within the packaging. The prior packaging systems have not permitted potential purchaser to actuate and view the launching of a projectile from the packaged product and to observe the motion of the projectile free of the launching device. A number of problems including defining internal spaces for the flight or movement of the projectile after it is launched and released from a launching apparatus, the resetting of the projectile in the launcher to facilitate the demonstration of action to a subsequent potential purchaser, assuring the launched projectile will not exit the packaging, among others, are faced by the manufactures and/or packagers of such products. Accordingly, needs exist for apparatus and methods for packaging products designed to launch projectiles which can permit their demonstration to potential retail purchasers.

SUMMARY OF THE INVENTION

Apparatus and methods in accordance with the present inventions may resolve one or more of the needs and shortcomings discussed above and will provide additional improvements and advantages as will be recognized by those skilled in the art upon review of the present disclosure.

In certain aspects, the present inventions may provide a packaging apparatus and methods that allow the consumer to initiate and observe the motion of the object within packaging apparatus. In other aspects, apparatus and methods in accordance with aspects of the present inventions can demonstrate the motion of a launched projectile to potential purchasers without the risk of the object exiting the packaging, thus presenting a potential hazard or making the sample of the packaged product defective.

A launch apparatus in accordance with the present inventions may include a launcher, a projectile, and a disposable packaging. The launcher may be formed from a launcher housing. The projectile may be releasably secured to the launcher. In one dimension, the projectile defines a length. The disposable packaging has an inner surface. The inner surface defines a flight chamber adapted to contain the projectile after the projectile is launched from the launcher. The launching sends the projectile into motion independent of the launcher. The motion of the projectile may be visible from outside the disposable packaging. The packaging material may at least in part be substantially transparent to allow the visualization of the projectile within the flight chamber. The launch cavity may extend for a distance which is greater than the length of the projectile in at least one location within the flight chamber.

A method in accordance with the present inventions may include various steps of launching a projectile within a flight cavity. One step may include providing a launcher configured to launch a projectile. Another step may include securing a disposable packaging over a portion of the launcher where the disposable packaging includes an inner surface defining a flight chamber. Another step may include launching the projectile into the flight chamber from a launching portion of the launcher. Another step may include receiving the projectile on the launch portion of the launcher. Another step may include resetting the projectile in the launcher for a subsequent launch. Other steps may include prior to launch, after launch and in between may also be included in the present inventions.

Figure 1:
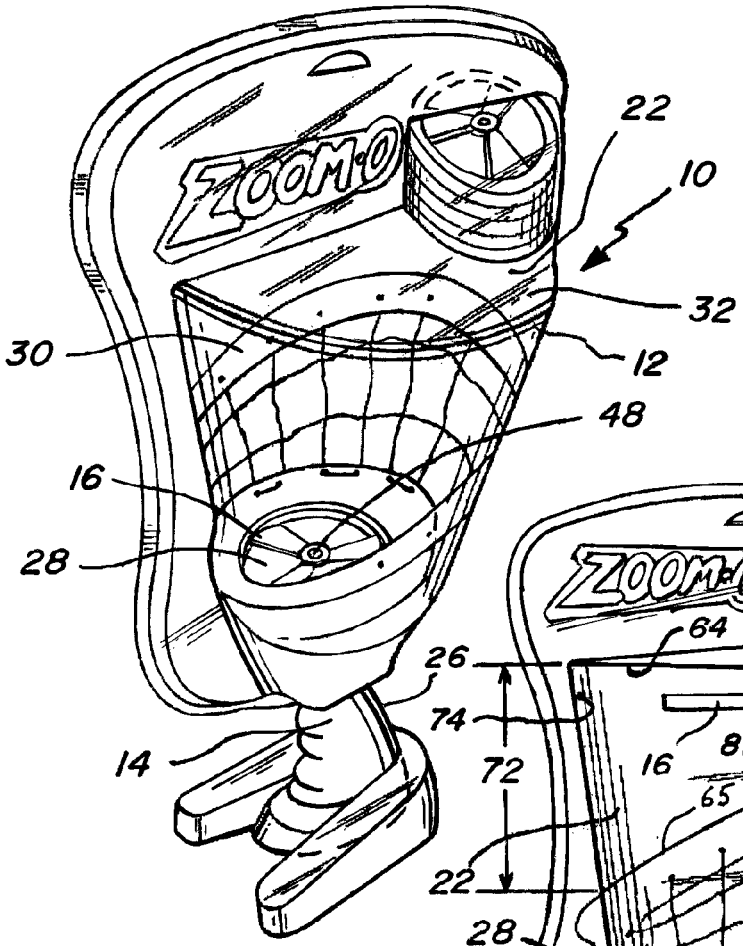
FIG. 1 illustrates a perspective view of an exemplary embodiment of an apparatus in accordance with aspects of the present inventions.

All Figures are illustrated for ease of explanation of the basic teachings of the present invention only; the extensions of the Figures with respect to number, position, relationship and dimensions of the parts to form the embodiment will be explained or will be within the skill of the art after the following description has been read and understood. The exact dimensions and dimensional proportions to conform to specific force, weight, strength, flow and similar requirements will likewise be within the skill of the art after the following description has been read and understood.

Where used in various Figures of the drawings, the same numerals designate the same or similar parts. Furthermore, when the terms "top," "bottom," "right," "left," "forward," "rear," "first," "second," "inside," "outside," and similar terms are used, the terms should be understood in reference to the drawings and utilized only to facilitate describing the illustrated embodiments. Typically, these terms are ascribed and should be understood to reference the structures shown in the drawings as they will typically be utilized by a purchaser or other user.

DETAILED DESCRIPTION OF THE INVENTIONS

The present inventions provide packaging apparatus 10 and associated methods for demonstration of launched projectiles to potential purchasers. The figures generally illustrate embodiments of packaging apparatus 10 including aspects of the present inventions. The particular exemplary embodiments of the packaging apparatus 10 illustrated in the figures have been chosen for ease of explanation and understanding of various aspects of the present inventions. These illustrated embodiments are not meant to limit the scope of coverage but instead to assist in understanding the context of the language used in this specification and the appended claims. Accordingly, variations of packaging apparatus 10 to demonstrate the flight of projectiles which are different from the illustrated embodiments may be encompassed by the appended claims.

Packaging apparatus 10 are generally configured to be displayed in a retail sales environment where the packaging apparatus 10 is presented to potential purchasers for purchase. Generally, the packaging apparatus 10 is configured for packaging a launcher 14 configured to launch a projectile 16. The packaging apparatus 10 may be configured to be stacked, hung or otherwise assembled in a store display or aisle. Various additional components and features may be added to the packaging apparatus 10 to provide or better provide for their display, transport, protection of the product or otherwise as will be recognized by those skilled in the art upon review of the present disclosure.

As generally illustrated throughout the figures, the packaging apparatus 10 may include a disposable housing 12, a launcher 14 and a projectile 16 in accordance with various aspects of the present inventions. The launcher 14 is generally configured to releasably retain or otherwise receive the projectile 16 before launch or release. In one aspect, the launcher 14 may be configured to impart motion to the projectile 16. In another aspect, the launcher 14 may be configured to release a self propelled projectile 16. The launcher 14 may be configured to launch projectile 16 into the air or to direct it over a surface. The launcher 14 may be further configured to catch a projectile 16 launched from the same launcher 14 or from another launcher 14. The projectile 16 may be generally configured to move through the air, drive along the ground or otherwise be launched from the launcher. The projectile 16 may be configured to fly, glide or free fall through the air after launch. The disposable housing 12 defines a cavity 22 into which the projectile 16 is launched or released. In combination with at least a portion of the launcher 14, the cavity 22 may define a launch chamber 32.

The cavity 22 of the disposable housing 12 is generally configured to receive at least a portion of the launcher 14 and to permit the motion of the projectile 16 after its launch or release from the launcher 14. The cavity 22 is typically defined by the inner surface 24 of the disposable housing 12. In certain aspects, the cavity 22 may be further configured to at least in part guide the projectile 16 back to the launcher 16. The cavity 22 in combination with a least a portion of the launcher 14 may define a launch chamber 32. The launch chamber 32 may be defined as the area between cavity 22 and a surface of at least a portion of the launcher 14 with dimensions sufficient to receive a launched projectile 16.

The launch chamber 32 may be configured to generally retain the projectile 16 after the launch or release of the projectile 16 from the launcher 14. In some aspects, the cavity 22 may be further configured to guide the projectile 16 back to the launcher 14. The launch chamber 32 may generally extend away from the launcher 14 to define a space for the movement of the projectile 16 independent of the launcher 14. In certain aspects, the cavity 22 may extend beyond a launch surface 65, actual or imaginary, which can be defined by the peripheral or upper structure of the launcher 14 adjacent the receiving portion 28 of the launcher 14. The launch surface 65 typically represents the point at which the projectile 16 is clear of the structure of the launcher 14 after its launch. In certain exemplary embodiments, the launch surface 65 may be a surface defined by the lip of the guide 30. The launch surface 65 may be planar, may include multiple planes or may include curved planes. At one or more locations, the cavity 22 may extend from the launch surface 65 of the launcher 22 for a distance 72 which is equal to or greater than the length 82 of the projectile 16. This distance is measured internally within cavity 22. The length 82 is defined as the dimension of the projectile 16 along an axis parallel to direction of motion of projectile 16 as it is launched from the launcher 14. In one aspect, the distance 72 may be at least two times the length 82 in at least one location within the cavity 22. In another aspect, the distance 72 may be at least three times the length 82 in at least one location within the cavity 22. In another aspect, the distance 72 may be at least five times the length 82 in at least one location within the cavity 22.

As discussed, at least a portion of the cavity 22 of the disposable housing 12 and at least a portion of the launcher 14 cooperate to define a launch chamber 32. At least a portion of the disposable housing 12 is translucent or otherwise configured to permit the observation of the projectile 16 within the launch chamber 32. In one aspect, at least a portion of cavity 22 is transparent to permit the observation of the projectile 16 within the launch chamber 32. In certain aspects, the launch chamber 32 may be configured to contain a liquid such as water and to retain the water for at least a defined period from the manufacture to the estimated earliest time of sale of a retail product.

More particularly, the launcher 14 may be a toy, a piece of sporting equipment, a tool or other launching device as will be recognized by those skilled in the art upon review of the present disclosure. The launcher 14 is configured to launch or release a projectile 16 into motion. The launcher 14 may be configured to confer a mechanical force upon the projectile to set the projectile into motion. The mechanical force may be provided by a motor 36, may be provided by a user, or may be otherwise provided as will be recognized by those skilled in the art upon review of the present disclosure. The motion may be conferred by direct mechanical interaction, magnetic, pneumatic, hydraulic, or other mechanical interactions that will be recognized by those skilled in the art upon review of the present disclosure. Alternatively or additionally, the launcher 14 may be configured to electrically charge a component of the projectile or wind or otherwise transfer mechanical energy to the projectile. After removal from the disposable packaging, the projectile 16 is typically free from any mechanical links, such as tethers, rods, or otherwise, to the launcher 14.

The launcher 14 includes a launcher housing 20. The launcher housing 20 may be a single component or may include a multiple subcomponents secured to one another. Depending on the particular configuration, the launcher housing 20 may define a handle 26 and may secure one or more of shafts, gears, wheels, motors, valves, tubes, pumps, actuators, batteries, reservoirs, electronics, triggers among other components for charging, powering, driving, launching and/or releasing the projectile 16. A receiving portion 28 is defined on the launcher housing 20 to receive the projectile 16 after the launch or release of the projectile 16. In one aspect, the receiving portion 28 may be configured to receive the projectile 16 after the launcher 14 is removed from the disposable housing 12. In another aspect, the receiving portion 28 may be configured to receive the projectile 16 solely in cooperation with the portion of the disposable housing 12 defining the cavity 22. In yet another aspect, the receiving portion 28 may be configured to receive the projectile 16 both before and after the launcher 14 is removed from the disposable housing 12. An actuator 48 may be positioned on or about the receiving portion 28. The actuator 48 may be configured to at least one of retain the projectile 16 prior to launching or to impart motion to launch the projectile 16. The receiving portion 28 may cooperate with a guide 30 to assist in the recapture of a projectile 16 and/or to direct a projectile 16 to the receiving portion 28. The guide 30 may be formed as a flange, a lip, webbing, netting, an enlarged opening, otherwise as will be recognized by those skilled in the art upon review of the present disclosure or may be formed from a combination of such elements.

The projectile 16 is configured to be launched or released from the launcher 14 into independent motion. The motion will typically be generally linear or rotational. In one aspect, the projectile 16 may be in a configuration which is capable of flying, hovering or gliding after launch or release. In this aspect, the projectile 16 may be formed to generate lift when in motion. Such a projectile 16 may include at least one a wing, a propeller, a lifting body portion and/or other configurations that have a tendency to generate lift while moving. In other aspects, the projectile 16 may be in a configuration that tends to free fall after launch or release. In this aspect, the projectile 16 may be in a form that does not tend to generate lift while in motion. Such a projectile 16 may include a ball, a figurine, a toy vehicle and/or other form that have a tendency not to generate substantial lift while moving. In yet other aspects, the projectile may be configured to roll, slide or otherwise traverse over or along the ground. Such a projectile 16 may include a ball, a figurine, a toy vehicle and/or other form. The launcher 14 may cooperate with the projectile 16 to impart motion on the projectile. In certain aspects, the projectile 16 may also or alternatively be motorized.

The disposable housing 12 is generally configured to be removably secured over at least a portion of the launcher 14. The launcher 14 is typically removably secured within the disposable housing 12 such that the removal of the launcher 14 from the disposable housing 12 will typically require the disassembly, disfigurement or destruction of the disposable housing 12 to un-package the launcher 14. The disposable housing 12 may at least in part be formed from a clear polymeric material. However, the disposable housing 12 may also be formed from various cellulose based materials, metals, or other materials or combinations of materials that will be recognized by those skilled in the art upon review of the present disclosure. The materials and overall configuration of the disposable housing 12 are generally dictated by the packaging, shipping and display requirements for the particular launcher 14 that is being packaged. Frequently, the disposable housing 12 will be molded from one or more sheets of translucent plastic and may contain various internal or external cardboard inserts 62. These inserts 62 may be used for ornamental, structural and/or other purposes such as providing a surface for printing information. The one or more inserts 62 may be combined into a disposable housing 12 in accordance with aspects of the present inventions.

The disposable housing 12 is generally configured to permit a potential purchaser to operate at least some of the controls of the launcher 14 to permit the movement of a projectile 16 to be demonstrated. An inner surface 24 of the disposable housing 12 generally defines a cavity 22. The cavity 22 is generally configured to permit the observation of the movement of the projectile 16 free of the launcher 14. The disposable housing 12 may further define a cavity opening 52 through which at least a portion of the launcher 14 may be received. A launcher passage 42 may be further defined by the inner surface 24 of the disposable housing 12. The launcher passage 42 may be configured to securably receive at least a portion of the launcher 14. In certain configurations, the cavity 22 may permit the free flight of a projectile 16 within the cavity 22. In other configurations, the inner surface 42 of the cavity 22 may guide a projectile 16 through a desired motion within the cavity 22. The cavity 22 may receive at least a portion of the launcher 14 through the launcher passage 42.

The launcher 14 may be removably secured within the launcher passage 42 such that the removal of the disposable housing 12 from the launcher 14 will typically require the disassembly, disfigurement or destruction of the disposable housing 12. Portions of the inner surface 24 defining the cavity 22 may cooperate with the receiving portion 28 and/or guide 30 to direct projectile 16 back toward the receiving portion 28 after the projectile 16 has been launched or released from the launcher 14. In one aspect, a portion of the launcher housing 20 may cooperate with the inner surface 24 to enclose the launcher passage 42 to define the launch chamber 32.

Figure 2:
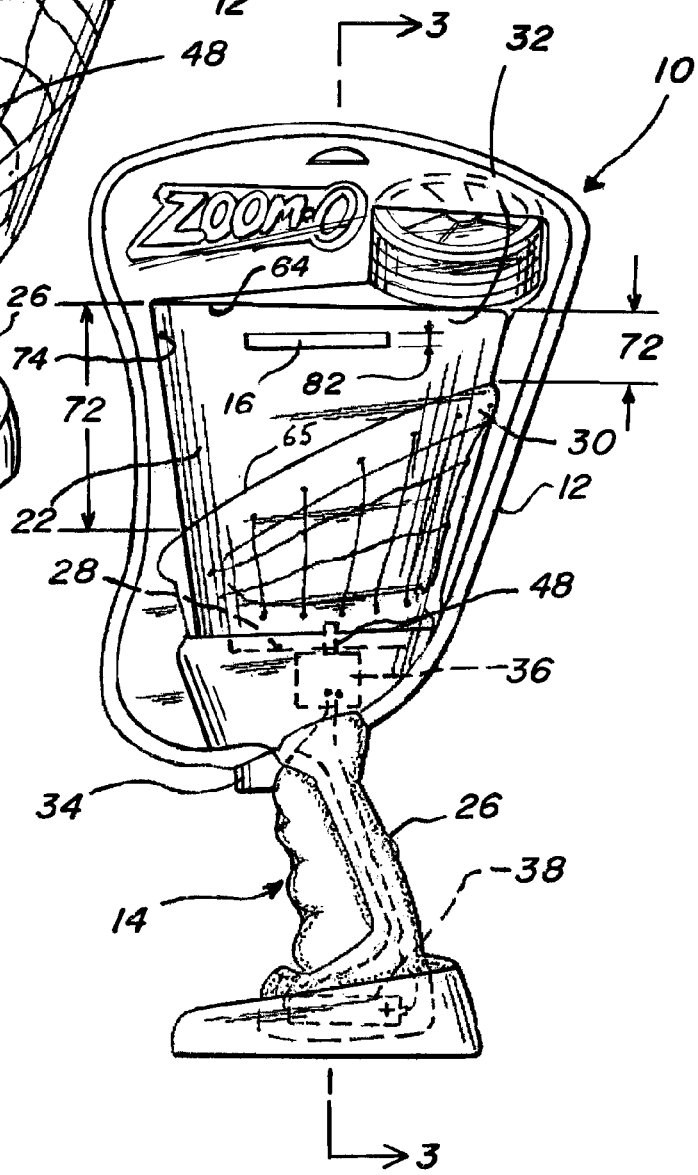
FIG. 2 illustrates a side view of the exemplary embodiment of an apparatus in accordance with aspects of the present inventions of FIG. 1.
Figure 3:
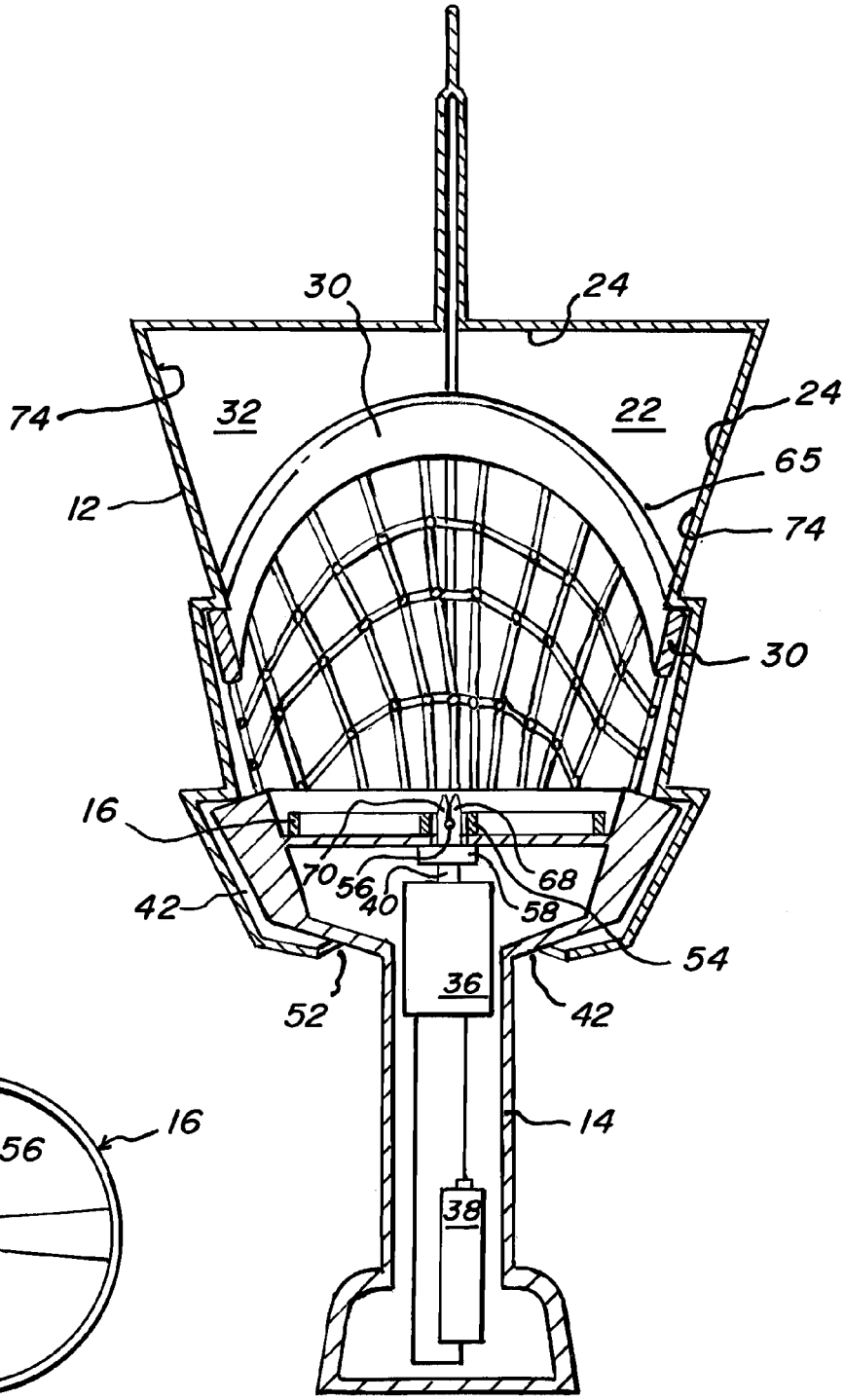
FIG. 3 illustrates a front view in cross-section through a frontal plane an exemplary embodiment of an apparatus in accordance with aspects of the present inventions of similar to the apparatus of FIG. 1.

As particularly illustrated for exemplary purposes in FIGS. 1, 2 and 3, embodiments of packaging apparatus 10 in accordance with aspects of the present inventions can include a disposable housing 12, a launcher 14 and a projectile 16. The launcher 14 is configured to confer a rotation motion to the projectile 16. The projectile 16 is shown in the form of a propeller or flying disc configured to fly when rotated at a sufficient speed. The disposable housing 12 is secured over a receiving portion 28 and guide 30 of the launcher 14. The inner surface 42 of the disposable housing 12 defines a cavity 22 and a launcher passage 42. The launcher passage 42 is generally configured to securably receive at least a portion of the launcher 14. A flight cavity 28 is defined by the cavity 22 of the disposable packaging and at least a portion of the launcher 14. An upper surface 64 of the cavity 22 is substantially flat. In one aspect, the projectile 16 may abut the upper surface 64 after launch and may hover above the launcher 14 for a period of time to be observed by a potential purchaser. At least a portion of the sides 74 may have a conical shape. As illustrated, the sides 74 of the launch cavity have a substantially frusto-conical shape and are configured to cooperate with the guide 30 to direct the projectile 16 toward the receiving portion 28 of the launcher 14.

As illustrated, launcher housing 42 of the launcher 14 defines a handle 24 with a trigger 34 toward the lower portion 44 of the launcher housing 20. The trigger 34 is shown positioned outside of the disposable housing 12 to permit access by a potential purchaser. The trigger 34 is operably connected to the actuator 48. The trigger 34 may be mechanically or electrically connected to the actuator. As illustrated, the trigger 34 is mechanically connected to an electrical switch which controls a motor 36. The motor 36 is powered by a battery 38 and rotates a drive shaft 40. The drive shaft 40 is configured to confer motion to the projectile 16. As illustrated, the drive shaft 40 includes a fitting 58 that is configured to confer a rotational force upon the projectile 16 and to release the spinning projectile 16 into free flight as illustrated in FIG. 2. After flight within the launch chamber 32, the flying disc may be reset within the receiving portion through the action of gravitational forces, the sides The disposable housing 12 is secured over an upper portion 46 of the launcher 14. The upper portion of the launcher is positioned through the launcher passage 42 into the cavity 22 of the disposable housing 12. Aspects of the inner surface 24 may be shaped to conform to at least part of the upper portion 46 of the launcher 14 to secure the disposable housing 12 to the launcher 14. The launcher passage 42 may, as illustrated, be smaller than an adjacent upper portion 46 of the launcher 14 to at least assist in maintaining the launcher 14 within the launcher passage 43 of the cavity 22. Other features of the cavity 22 may also function to secure the launcher 14 within the cavity 22 and in a desired position relative to the cavity 22, as generally illustrated.

Figure 4:
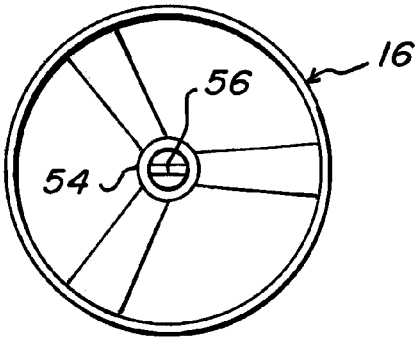
FIG. 4 illustrates a top view of an embodiment of a projectile in accordance with aspects of the present inventions.

As particularly illustrated for exemplary purposes in FIG. 4, an embodiment of projectile 16 may be in the form of a propeller or flying disc. As illustrated, the projectile 16 includes a central hub 54 including a retention member 56. The retention member 56 is configured to communicate motion from the drive shaft 40 to the projectile 16. As particularly illustrated, fitting 58 configured to receive the retention member 56 is secured to the drive shaft 40. More particularly, the motor 38 rotates the drive shaft 40 which rotates the fitting 58 which causes rotation of the projectile 16 by contacting the retention member 56 of the projectile. For exemplary purposes, the fitting is illustrated with a first projecting finger 68 and a second projecting finger 70 (shown in FIG. 3) that insert into central hub 54 of the projectile 16 and receive the retention member 56. As illustrated, the projectile 16 is held in position on the fitting 58 by gravitational forces. In other aspect, projectile 16 may be held in position with additional mechanical elements or forces such as forces conferred by the rotation of the projectile 16.

Figure 5:
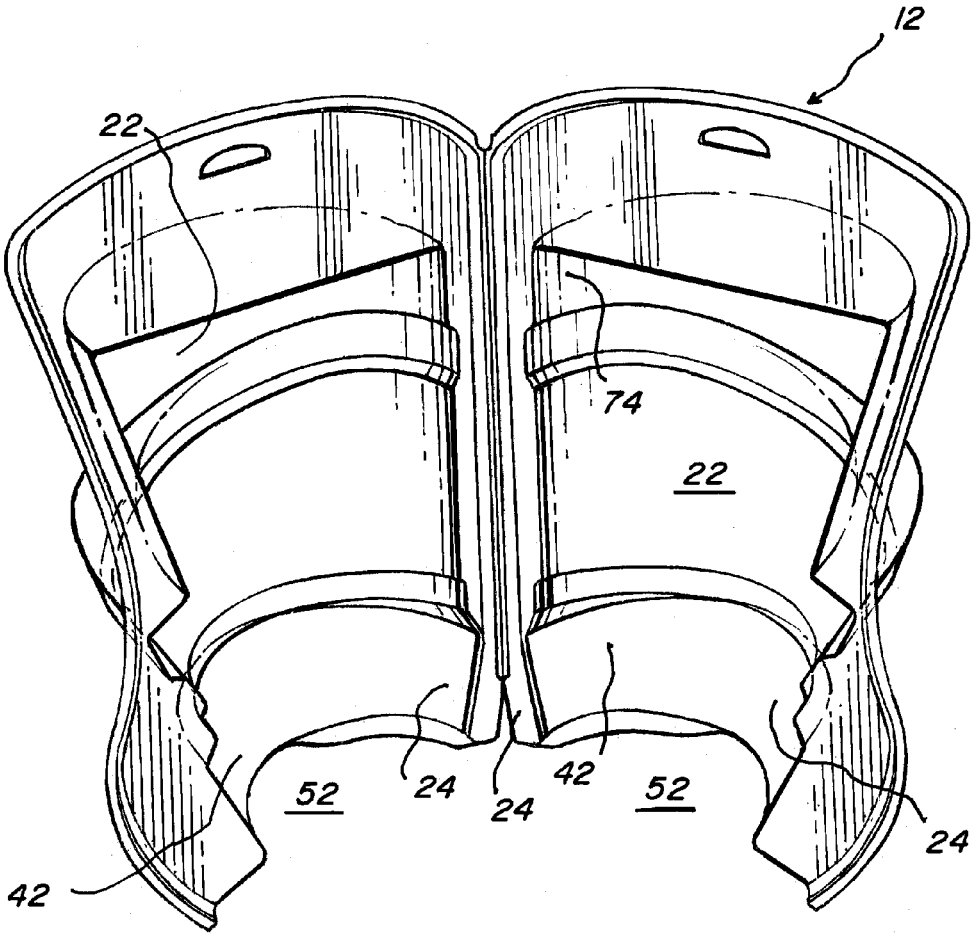
FIG. 5 illustrates an elevation of an embodiment of a disposable package in accordance with aspects of the present inventions.
Figure 6:
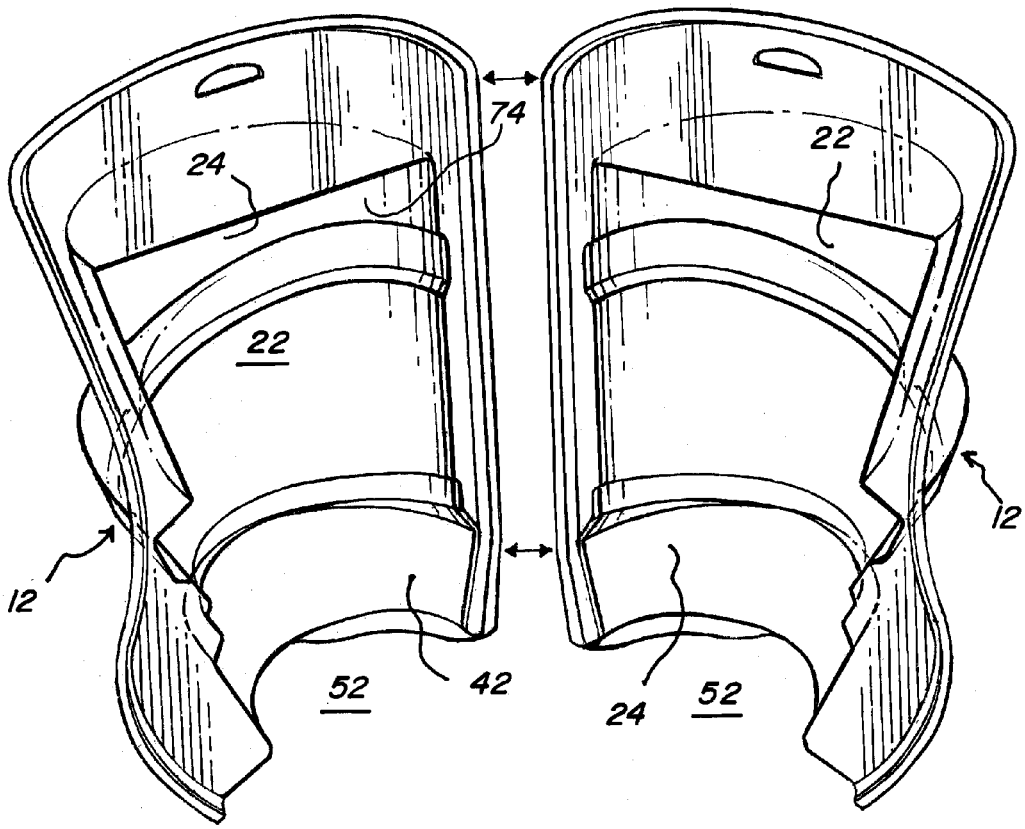
FIG. 6 illustrates an elevation of another embodiment of a disposable package in accordance with aspects of the present inventions.
Figure 7:
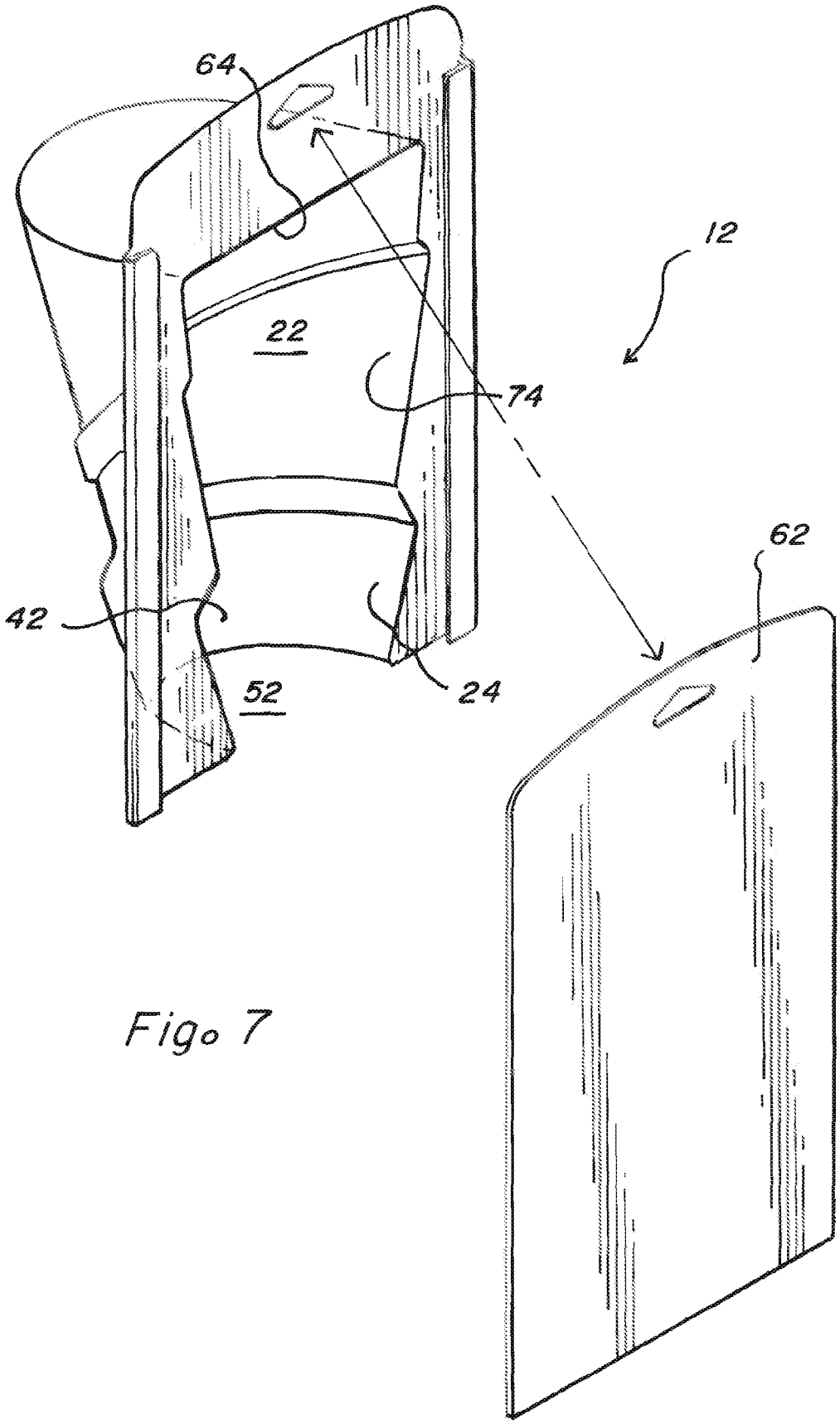
FIG. 7 illustrates an elevation of yet another embodiment of a disposable package in accordance with aspects of the present inventions.

As particularly illustrated for exemplary purposes in FIGS. 5, 6 and 7, embodiments of disposable packaging may have various configurations. The disposable housing 12 may be transparent or may have a window 13 that allows motion of the object to be viewed from outside the packaging. Non-limiting examples of materials from which the disposable housing 12 may be made are: clamshell blister plastic; cardboard, paper, fabric, wood, or metal, all with plastic windows; or netting. FIG. 5 illustrates an exemplary disposable housing 12 having an inner surface 24 defining a cavity 22 configured to secure a launcher 14 similar to the embodiments shown in FIGS. 1 to 3. The disposable housing 12 of FIG. 5 is configured in a clam shell for exemplary purposes. After the fitting of the launcher 14 and any documentation into the disposable housing 12, the sides of the disposable housing 12 on opposite sides of a hinged or bent portion are brought together and secured to one another. Typically, the edges of the disposable housing 12 are secured with an adhesive or are welded to one another to retain the packaged launcher 14 within the disposable housing 12. FIG. 6 illustrates an exemplary disposable housing 12 having an inner surface 24 defining a cavity 22 configured to secure a launcher 14 similar to the embodiments shown in FIGS. 1 to 3. The disposable housing 12 shown as in a two piece configured for exemplary purposes. After the fitting of the launcher 14 and any documentation into the first half of the disposable housing 12, the two halves of the disposable housing 12 are brought together and secured to one another. Typically, the edges are secured with an adhesive or are welded to one another to retain the packaged launcher 14 within the disposable housing 12. In one aspect, the edges are secured circumferentially up to about the launcher passage 42. FIG. 7 illustrates another exemplary disposable housing 12. For exemplary purposes, the disposable housing 12 shown includes a first component and a backing. The first component has an inner surface 24 defining a cavity 22 configured to receive the launcher 14. Again, the cavity 22 is configured to secure a launcher 14 similar to the embodiments shown in FIGS. 1 to 3. After the fitting of the launcher 14 and any documentation into the first component of the disposable housing 12, the backing is secured over the cavity 22. Typically, the edges are secured with an adhesive or are welded to one another to securely retain the packaged launcher 14 within the disposable housing 12.

Figure 8:
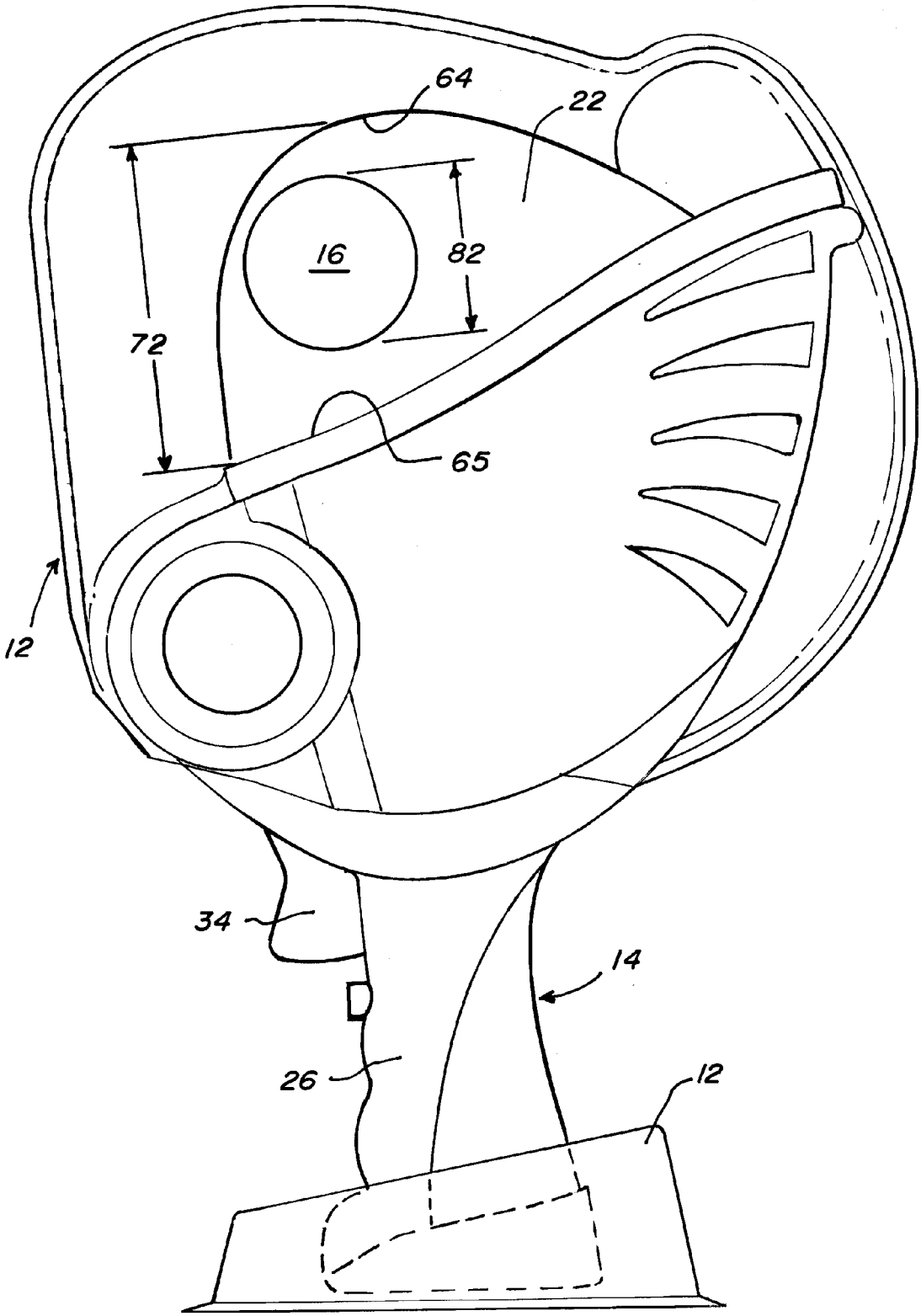
FIG. 8 illustrates a side view of another embodiment of an apparatus in accordance with aspects of the present inventions.

FIG. 8 illustrates another exemplary embodiment of a packaging apparatus 10 in accordance with aspects of the present inventions. The illustrated packaging apparatus 10 includes a disposable housing 12, a launcher 14 and a projectile 16. The launcher 14 is configured to launch a projectile 16 in the form of a ball. The illustrated launcher 14 may be driven by a motor 36 or by a user. The disposable housing 12 is secured over a receiving portion 28 (not shown) and guide 30 of the launcher 14. The inner surface 42 of the disposable housing 12 defines a cavity 22 and a launcher passage 42. The launcher passage 42 is generally configured to securably receive at least a portion of the launcher 14. An upper surface 64 of the cavity 22 is curved to direct a projectile 16 launched from the launcher 14 toward the guide 30. In one aspect, the projectile 16 may abut the upper surface 64 after launch and may roll along the upper surface of the cavity 22 above the launcher 14 for a period of time to be observed by a potential purchaser. The sides 74 of the cavity 22 are substantially flat and parallel to one another and are configured to cooperate with the guide 30 to direct the projectile 16 toward the receiving portion 28 of the launcher 14 after launch. The ball may be reset in the illustrated launcher 14 by seating in the receiving portion 28 in a position to permit the re-launch of the ball by actuator 48.

Figure 9:
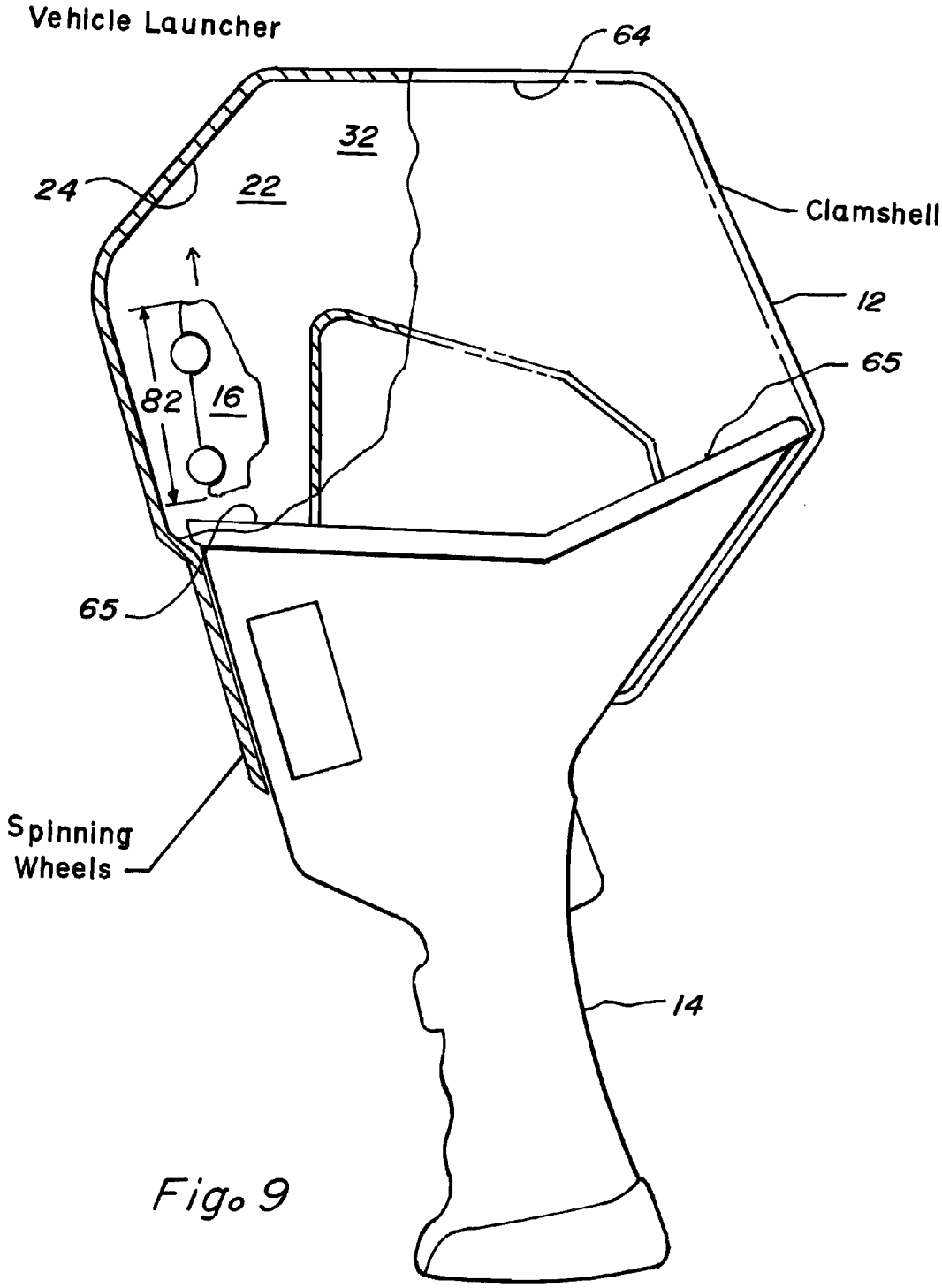
FIG. 9 illustrates a side view of another embodiment of an apparatus in accordance with aspects of the present inventions.

FIG. 9 illustrates another exemplary embodiment of a packaging apparatus 10 in accordance with aspects of the present inventions. The illustrated packaging apparatus 10 includes a disposable housing 12, a launcher 14 and a projectile 16. The launcher 14 is configured to launch a projectile 16 in the form of a motor vehicle. However other forms of projectiles 16 that are configured to move or roll over a surface may be utilized in a launcher 14 similar to the illustrated embodiment. The illustrated launcher 14 again may be driven by a motor 36 or by a user. In one aspect, the actuator 48 may include a push rod that imparts motion to the projectile 16. The disposable housing 12 is secured over a receiving portion 28 (not shown) and guide 30 of the launcher 14. The inner surface 42 of the disposable housing 12 defines a cavity 22 and a launcher passage 42. The launcher passage 42 is generally configured to securably receive at least a portion of the launcher 14. An upper surface 64 of the cavity 22 includes an arcing series of substantially planar sections to direct a projectile launched from the launcher 14 toward the guide 30. In one aspect, the projectile 16 may roll along the upper surface 64 after launch for a sufficient period of time to be observed by a potential purchaser. The sides 74 of the cavity 22 are substantially flat and parallel to one another and are configured to cooperate with the guide 30 to direct the projectile 16 toward the receiving portion 28 of the launcher 14 after launch to reset the projectile 16 in the launcher 14. The motor vehicle may be reset in the illustrated launcher 14 by seating in the receiving portion 28 in a position to permit the re-launch of the motor vehicle by actuator 48.

Figure 10:
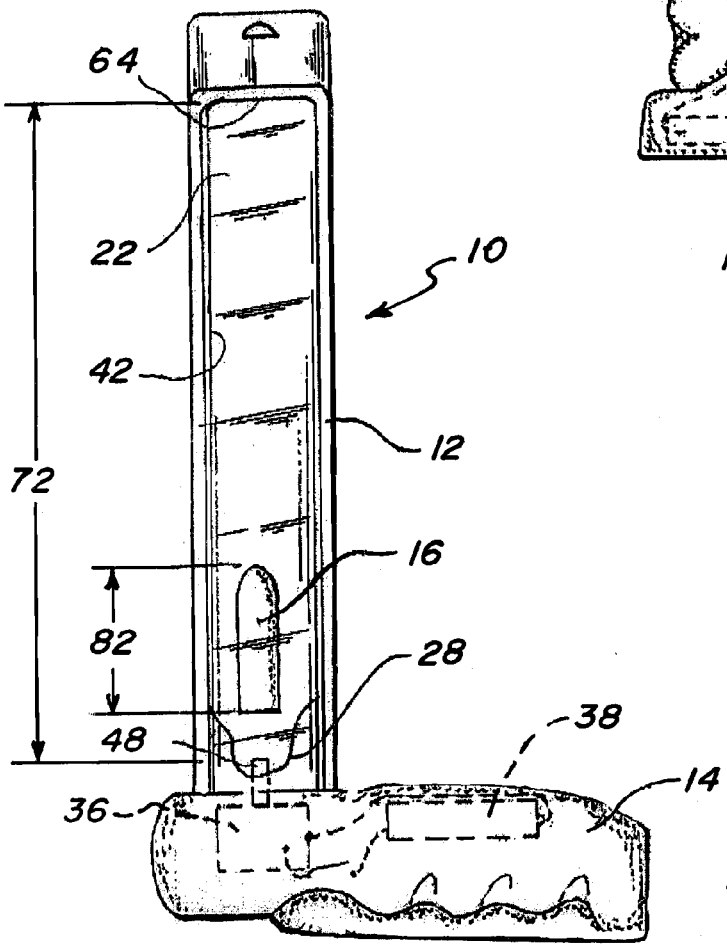
FIG. 10 illustrates a side view of another embodiment of an apparatus in accordance with aspects of the present inventions.

FIG. 10 illustrates an embodiment of the packaging apparatus 10 where the projectile 16 is configured in the form of a missile. As illustrated, the launcher 14 launches a projectile 16 using air pressure. The launcher 14 may include a mechanical or electrical pump to develop the positive air pressure to propel the projectile 16. The pump may driven by an electric motor 36 which obtains power from a battery 38 as illustrated for exemplary purposes. The cavity 22 is defined by an inner surface 42 of the disposable packaging. The disposable housing 12 is secured over a receiving portion 28 of the launcher 14 which is configured to include a nozzle as an actuator 48. Again, a flight cavity 28 is defined by the cavity 22 of the disposable packaging and at least a portion of the launcher 14. The nozzle may deliver pressurized air to a portion of the projectile 16 to confer motion on the projectile 16. The inner surface 42 of the disposable housing 12 defines a cavity 22 and a launcher passage 42. The launcher passage 42 is generally configured to securably receive at least a portion of the launcher 14 including the nozzle. An upper surface 64 of the cavity 22 includes flat surface to contact the projectile 16 launched from the launcher 14 toward the guide 30. In one aspect, the projectile 16 may be launched with sufficient force to contact upper surface 64. The sides 74 of the cavity 22 are rounded and are configured to guide projectile 16 toward upper surface 64 and back down to the receiving portion 28 including the actuator 48 configured as a nozzle and to seat a portion of projectile on the nozzle to reset the projectile 16 and permit its re-launch.

Figure 11:
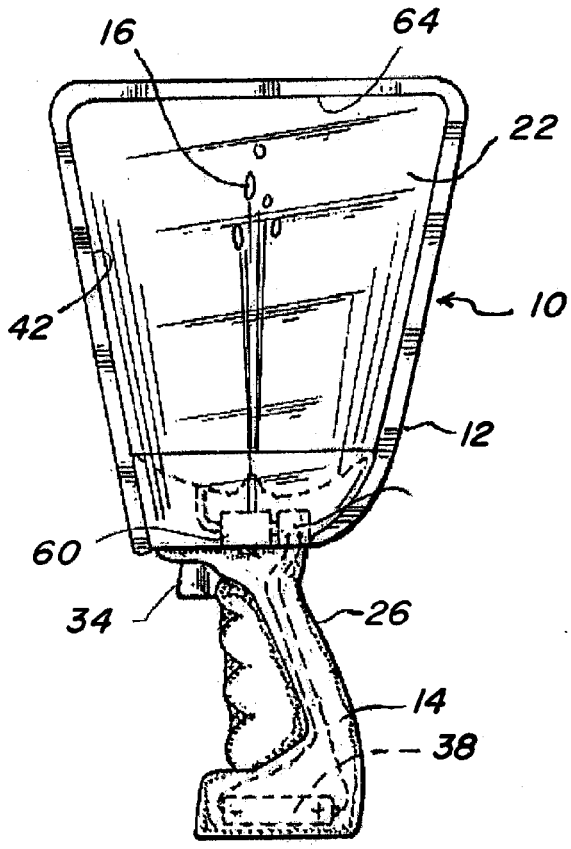
FIG. 11 illustrates a side view of another embodiment of an apparatus in accordance with aspects of the present inventions.

FIG. 11 illustrates a particular embodiment of the packaging apparatus 10 which includes a launcher 14 in the form of a squirt gun to shoot a projectile in the form of water or another liquid. As illustrated, the launcher 14 launches the water using air pressure. The launcher 14 may include a mechanical or electrical pump to develop the positive air pressure to propel the water from the launcher. The pump may driven by an electric motor 36 which obtains power from a battery 38 as illustrated for exemplary purposes. The cavity 22 is defined by an inner surface 42 of the disposable packaging. The disposable housing 12 is secured over a receiving portion 28 of the launcher 14 which is configured to include a nozzle as an actuator 48. Again, a flight cavity 28 is defined by the cavity 22 of the disposable packaging and at least a portion of the launcher 14. The water is retained in an internal reservoir 60. The nozzle is in fluid communication with the reservoir and directs the water from the launcher 14. The water is typically forced from the nozzle with pressurized air. The inner surface 42 of the disposable housing 12 defines a cavity 22 and a launcher passage 42. The launcher passage 42 is generally configured to securably receive at least a portion of the launcher 14 including the nozzle. In the illustrated embodiment, a water tight seal is typically formed between the launcher 14 and the disposable housing 12. The sides 74 of the cavity 22 are direct the flow of water toward the receiving portion 28. A conduit 60 directs the water from the receiving portion 28 into the reservoir 60. In the present embodiment, the refilling of the reservoir 60 may represent the retting of the projectile to permit its re-launch.

Figure 12:
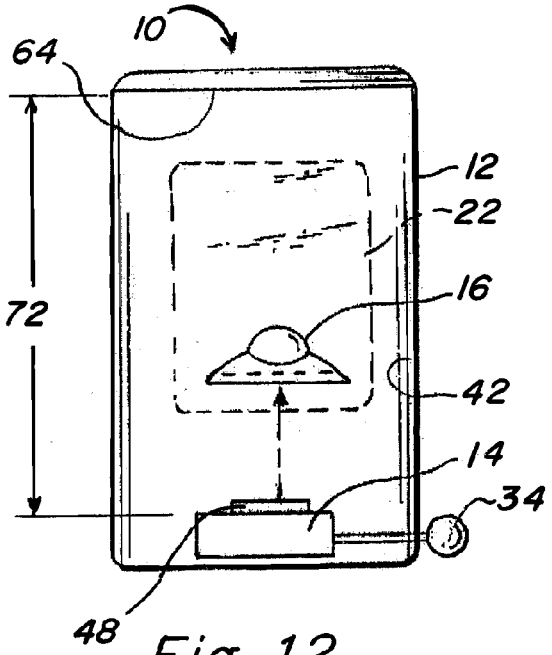
FIG. 12 illustrates a side view of another embodiment of an apparatus in accordance with aspects of the present inventions.

FIG. 12 illustrates an embodiment of the packaging apparatus 10 which includes a launcher 14 that launches a projectile 16 in the form of a flying saucer. The launcher 14 is preferably driven mechanically by a user. The illustrated packaging apparatus 10 includes a disposable housing 12, a launcher 14 and a projectile 16. The launcher 14 is configured to launch a projectile 16 in the form of a flying saucer. The illustrated launcher 14 may be driven by a motor 36 or by a user. The disposable housing 12 is secured over a receiving portion 28 (not shown) of the launcher 14. The inner surface 42 of the disposable housing 12 defines a cavity 22. The cavity 22 is generally configured to securably receive at least a portion of the launcher 14. An upper surface 64 of the cavity 22 is curved to direct a projectile 16 launched from the launcher 14 toward the guide 30. In one aspect, the projectile 16 may abut the upper surface 64 after launch and may be guided by the sides 74 of the cavity 22 back onto the launcher 14. The sides 74 of the cavity 22 are illustrated as substantially flat and parallel to one another and are configured to direct the projectile 16 toward the receiving portion 28 of the launcher 14 after launch. The flying saucer may be reset in the illustrated launcher 14 by seating in the receiving portion 28 in a position to permit the re-launch of the flying saucer by actuator 48.

The foregoing discussion discloses and describes merely exemplary embodiments of the present invention. Upon review of the specification, one skilled in the art will readily recognize from such discussion, and from the accompanying drawings and claims, that various changes, modifications and variations can be made therein without departing from the spirit and scope of the invention as defined in the following claims.

What is claimed is:

1. An apparatus, comprising:

a launcher including a launcher housing and defining a launch surface;

a projectile releasably secured to the launcher, the projectile including a length; and a disposable packaging secured around at least a portion of the launcher, the disposable packaging including an inner surface defining a cavity, the cavity defining a launch chamber between the launcher and the inner surface, the launch chamber to contain the projectile after the projectile is launched from the launcher and while in motion independent of the launcher, the motion of the projectile being visible from outside the disposable packaging, the launch chamber extending for a distance from the launch surface of the launcher in at least one location which is greater than the length of the projectile, the launch chamber being sloped to guide the projectile back toward the launch surface to allow the projectile to reset.

2. The packaging apparatus, as in claim 1, comprising at least a portion of the disposable packaging being transparent.

3. The packaging apparatus, as in claim 1, comprising an inner surface of the disposable packaging defining an upper surface that is substantially flat.

4. The packaging apparatus, as in claim 3, comprising the launch surface of the launcher positioned a distance from the upper surface of the packaging, the distance from the launch surface to the upper surface of the packaging being at least three times the length of the projectile.

5. The packaging apparatus, as in claim 1, wherein the disposable packaging including a frusto-conical shape.

6. The packaging apparatus, as in claim 1, comprising an inner surface of the disposable packaging defining at least one side that is substantially flat.

7. The packaging apparatus, as in claim 1, comprising an inner surface of the disposable packaging defining at least a portion of a side having a conical shape.

8. The packaging apparatus, as in claim 1, comprising the projectile configured to at least one of fly, glide and free fall.

9. The packaging apparatus, as in claim 1, comprising the projectile configured to include a propeller.

10. A method, comprising:

providing a launcher configured to launch a projectile with a disposable packaging over a portion of the launcher, the disposable packaging including an inner surface defining a flight chamber;

launching the projectile into the flight chamber from a launching portion of the launcher;

retaining the projectile in flight within the flight chamber of the disposable packaging after the launching of the projectile;

receiving the projectile from the flight chamber of the disposable packaging on the launch portion of the launcher after launching and retaining; and resetting the projectile in the launcher for a subsequent launch.

11. The method of claim 10, wherein retaining includes retaining the projectile in a sloped launch chamber.

12. An apparatus, comprising:

a launcher including a launcher housing and an actuator and defining a launch surface, the actuator extending from the launch surface;

a flying disc configured to generate lift when rotated, the flying disc releasably secured over at least the actuator of the launcher over the launch surface, the actuator configured to confer a rotational motion on the flying disc, the flying disc defining a length; and a disposable packaging secured to at least a portion of the launcher, the disposable packaging having an inner surface defining a launch chamber, at least a portion of the launch chamber positioned over the launch surface, the inner surface defining a distance within the launch chamber greater than the length of the flying disc, the launch chamber including at least one side, the at least one side having a substantially frusto-conical shape adapted to guide the flying disc toward the launch surface of the launcher.

13. The apparatus, as in claim 12, comprising at least a portion of the disposable packaging being transparent.

14. The apparatus of claim 13, wherein the launch chamber includes an upper surface having a substantially flat portion adapted to receive the flying disc after the flying disc is launched from the launcher.

15. The apparatus of claim 12, wherein the launch chamber includes an upper surface having a substantially flat portion adapted to receive the flying disc after the flying disc is launched from the launcher.

* * * * *